United States Patent [19]

Sedlacek et al.

[11] 4,075,727

[45] Feb. 28, 1978

[54] FRAME STRUCTURE, ESPECIALLY FOR A PORTABLE BRIDGE

[75] Inventors: Hugo Sedlacek, Duisburg; Gerhard Sedlacek, Kamp-Lintfort, both of Germany

[73] Assignee: Fried. Krupp Gesellschaft mit beschrankter Haftung, Essen, Germany

[21] Appl. No.: 721,405

[22] Filed: Sep. 8, 1976

[30] Foreign Application Priority Data

Sep. 10, 1975 Germany ..... 2540267

[51] Int. Cl.[2] ..... F01D 19/00

[52] U.S. Cl. ..... 14/14

[58] Field of Search ..... 14/14, 17, 3, 1, 73; 52/731

[56] References Cited

U.S. PATENT DOCUMENTS

| | | | |
|---|---|---|---|
| 1,231,365 | 6/1917 | Inglis | 14/14 |
| 2,083,226 | 6/1937 | Dornier | 52/731 |
| 2,347,879 | 5/1944 | Brunton | 52/731 |
| 2,754,064 | 7/1956 | Voltz | 52/731 X |
| 3,103,025 | 9/1963 | Gassner | 14/1 |
| 3,181,187 | 5/1965 | Kahn | 14/73 |
| 3,257,764 | 6/1966 | Cripe | 52/731 X |
| 3,273,299 | 9/1966 | Hartung | 52/731 X |
| 3,736,710 | 6/1973 | Sterner | 52/731 X |
| 3,753,324 | 8/1973 | Puccio | 52/731 X |
| 3,886,613 | 6/1975 | Busch | 14/14 |

*Primary Examiner*—Nile C. Byers
*Attorney, Agent, or Firm*—Walter Becker

[57] ABSTRACT

A frame structure, especially for a portable bridge, which comprises at least one pair of struts to be interconnected and equipped with coupling members having such a profile that the coupling members when positively engaging each other permit a pivoting in which the coupling members are able to convey forces in all directions between the two struts. A pivoting back of one strut relative to the other strut from the coupling position is prevented by additional coupling elements.

13 Claims, 16 Drawing Figures

FIG. 1
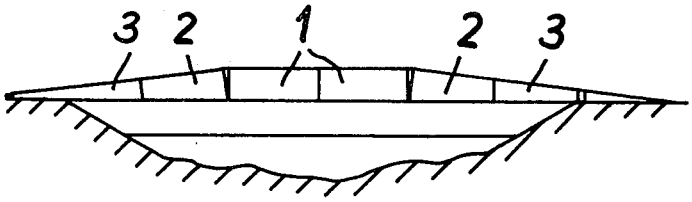
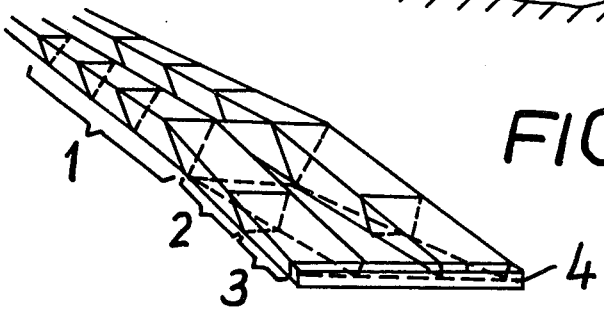
FIG. 2
FIG. 3
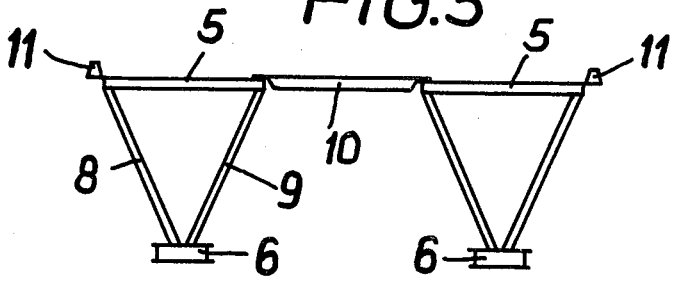
FIG. 4
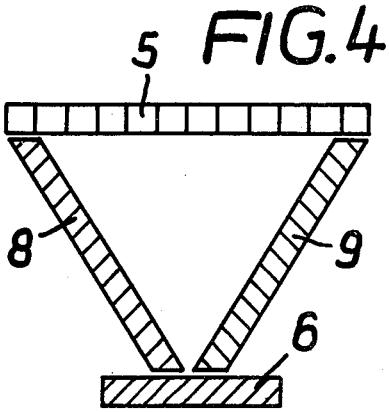
FIG. 5
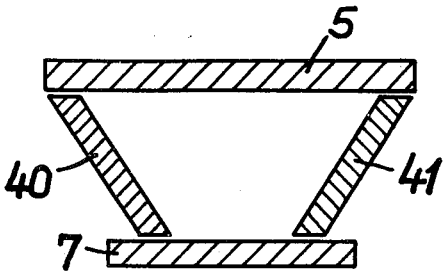

FRAME STRUCTURE, ESPECIALLY FOR A PORTABLE BRIDGE

In order to interconnect supporting discs of steel or other metals for instance aluminum (plates, supporting walls, main beams, etc.) in engineering, above all bridge-building and especially military bridge-building, rivets, screws and welding operations are utilized when the transfer of large forces of many tons are involved. These connecting techniques are used above all for permanent bridge structures where the assembly time is not the most important thing. However, when short assembly times are required, these connecting elements are not satisfactory and in most instances can practically not be used. This is true even more when problems have to be met by the connection with regard to the forces to be absorbed by the connection.

For instance, for bridge structures, especially bridges to be built by combat engineers, the requirements for extremely short building times are very important. In connection with this type of bridge structure, the transfer of forces was realized primarily by bolts or hinges and occassionally also by hooks. Hooks of the type as they are used in railway couplings can be applied quickly but they require considerable space and are very heavy. With bolt connections, the transfer of power usually with considerable stresses to be absorbed by the bolts and bore holes, causes shearing and bearing pressures, in other words acting planes perpendicular to the bolt axis.

Less frequently, a stress is exerted in the bolt axis by pull. Inasmuch as the bolt diameter and the distance between the bolts are dependent upon each other, it is necessary for transmitting a certain force to a number of bolts, to maintain a minimum distance between the bolts, and it is also necessary to maintain minimum width and length of the connecting surfaces. Corresponding dimensions, however, are not always available in modern military bridge building. Furthermore, the insertion and securing of the bolts requires considerable time which as a rule is not available. While sometimes the bolts are also fixedly inserted, this will not affect the great space requirement.

It is, therefore, an object of the present invention so to interconnect disc-shaped elements of a framework, especially a portable bridge, that between the elements great forces can be transmitted in all directions while the said interconnection can be effected within a minimum of time while using connecting means which can be produced at relatively low cost and require a minimum of space.

In particular, it is an object of the present invention to provide a framework, especially a portable bridge as set forth above, in which bolts and bore holes for transmitting great forces will be avoided so that the drawbacks of bolt connections as mentioned above will be eliminated and corrosion damage will be avoided which frequently is caused by an electrolytic effect when bolts for instance of steel are inserted in bore holes defined by aluminum walls.

These and other objects and advantages of the invention will appear more clearly from the following specification in connection with the accompanying drawings, in which:

FIG. 1 diagrammatically illustrates a side view of a military bridge, according to the invention.

FIG. 2 is a perspective view of the bridge shown in FIG. 1.

FIG. 3 represents a cross section through the central portion of the bridge of FIGS. 1 and 2.

FIG. 4 represents a first cross section through beams of the bridge.

FIG. 5 represents a cross section through another area of the beams of the bridge.

Figure 6:
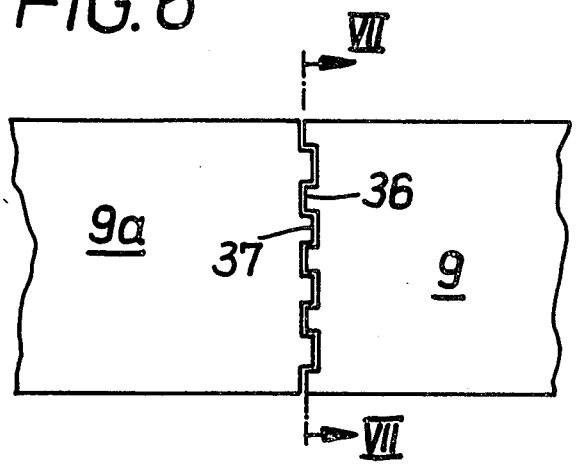
FIG. 6 is a side view of two walls of a beam coupled to each other.

FIGS. 14, 15 and 16 respectively illustrate in vertical section a portion of the lower chord and a portion of a wall in three different assembly positions.

The framework according to the invention especially for a portable bridge, composed of plates is characterized primarily in that at least one pair of plates to be interconnected comprises coupling elements of such profile that the coupling elements when positively interengaging each other permit a pivoting of one plate relative to the other plate in one coupling position in which the coupling elements are able to transmit forces in all directions between the two plates while a pivoting back of one plate relative to the other plate out of the coupling position is prevented by other coupled-on plates. All plates when in coupled condition at the coupling points form an angle with each other.

Referring now to the drawings in detail, the framework of the bridge according to FIG. 1 comprises two path beams or two tracks which are mounted in spaced relationship to each other. Each of these two beams or tracks comprises two (FIG. 1) or more (FIG. 2) normal beam sections the cross section in defining an isosceles triangle with an upper horizontal side. The two ends of said path beams or tracks are formed by two ramp-shaped beam sections 2, 3 each. The height of said sections 2, 3 steadily decreases from the normal beam sections 1 while the cross section gradually changes from the triangular shape of the cross section of the normal beam sections 1 into trapezoidal cross sections with ever decreasing height. The outer edges of the ramp-shaped beam sections 3 rest on a bank beam 4.

Each of the beam sections 1 to 3 is composed of four plates. One plate 5 forms a part of the upper chord of the path beam or track and at the same time forms a portion of the bridge driving path. The lower chord of the path beam or track is formed by narrow plates 6 at the bottom sides of the normal beam sections 1 as well as by plates 7 which close off at the bottom of the ramp-shaped beam sections 2, 3 and the width of which increases toward the bank beam or rolling element 4. Two further plates 8, 9 form the inclined side walls of the beam sections 1, 2, 3. The space between the plates 5 which form the upper chords of the two path beams is bridged by intermediate plates 10 which have their longitudinal edges resting on the rims of plates 5 which face each other. Guard rails 11 are connected to the outer rims of the plates 5. For purposes of connecting the plates 8, 9 forming the side walls, to the plate member 6, 7 forming the lower chord, coupling elements are provided which will be described below.

Figure 9:
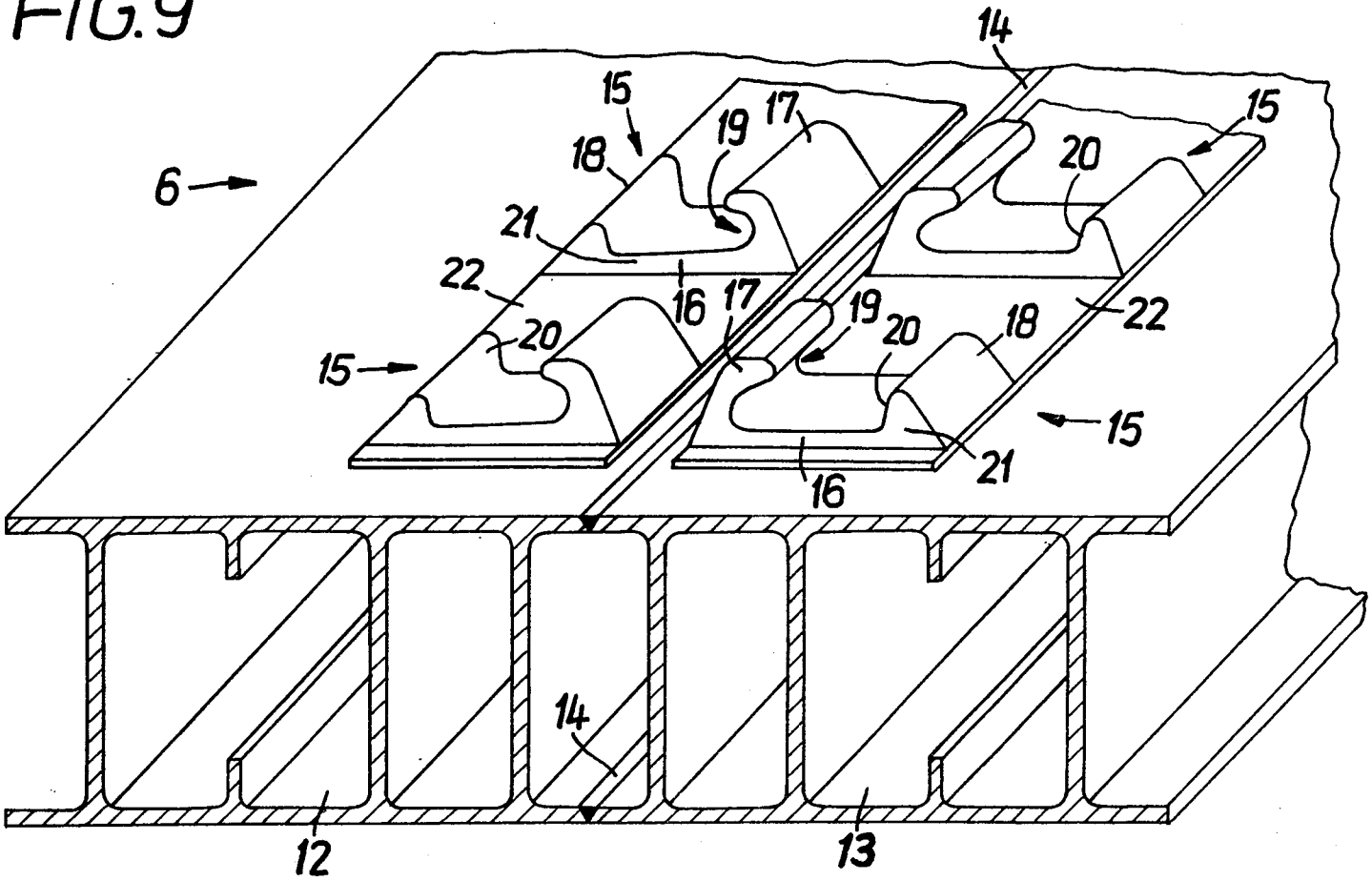
FIG. 9 shows an isometric view of a portion of the lower chord of the beam of the framework according to the invention.

A lower plate member 6 of a normal beam section 1 comprises, in conformity with FIG. 9, two extruded hollow box beam members 12, 13 the profiles of which form an image of each other with regard to the vertical longitudinal central plane of the plate member 6. The hollow box beam members 12, 13 are at their longitudinal edges facing each other, connected to upper and lower plates by means of welding seams 14. Mounted on the upper plate of the lower plate member 6 are four coupling elements 15 located in the vicinity of the two ends of said plate member 6. Each coupling element is formed by a plate-shaped elevation 16 and two cams, of which one cam 17 projects from that end of the elevation 16 which faces the welding seam 14 whereas the other cam 18 projects from the opposite end of the elevation 16. The cam 17 has a hook-shaped profile and forms a fillet or channel 19 on that side which faces away from the welding seams 14. The cam 18 is slightly lower and has that side thereof which faces the cam 17 provided with an engaging surface 20. Each coupling member 15 has two vertical end faces 21 which extend at a right angle to the longitudinal direction of the plate member 6. Two of the coupling members 15 each are arranged in the manner of an image to each other with regard to the vertical longitudinal plane of plate member 6. On each side of the welding seam 15 there are provided two coupling members 14 which are spaced from each other.

When plate member 6, as shown in FIG. 9, is produced by extrusion pressing the two hollow box beam members 12, 13, having abutting upper and lower portions which are welded together to form the lower plate member 6. The coupling members 15 consist of one piece with the hollow box beam members 12, 13. Their profile is confined by the extrusion press profile of the hollow box beam members 12, 13. Following the extrusion pressing, each of the hollow box beam members 12, 13 first has a strip extending over its entire length with the profile of the coupling members 15. Thereupon, said strip is interrupted by a chip-removing machining so that only the coupling members with a low machining strip 22 therebetween are retained. In this connection, also the end faces 21 are machined.

A plate 9 which forms one of the inclined side walls of a normal beam section 1 has a lower rim piece 23 and an upper rim piece 24. Each of these two rim pieces has an identical shape of an extrusion pressed hollow body. These two rim pieces 23, 24 are interconnected by two plane parallel plates 25 the longitudinal rims of which extend over stepped strips 26 of the rim pieces 23, 24 in such a way that their outer surfaces are flush with the outer surfaces of the rim pieces. The two rim pieces 23, 24 are fixedly connected to said plates 25, by means of welding seams 27. The plates 25 in a manner known per se are reinforced by non-illustrated cone-shaped elevations.

Figure 13:
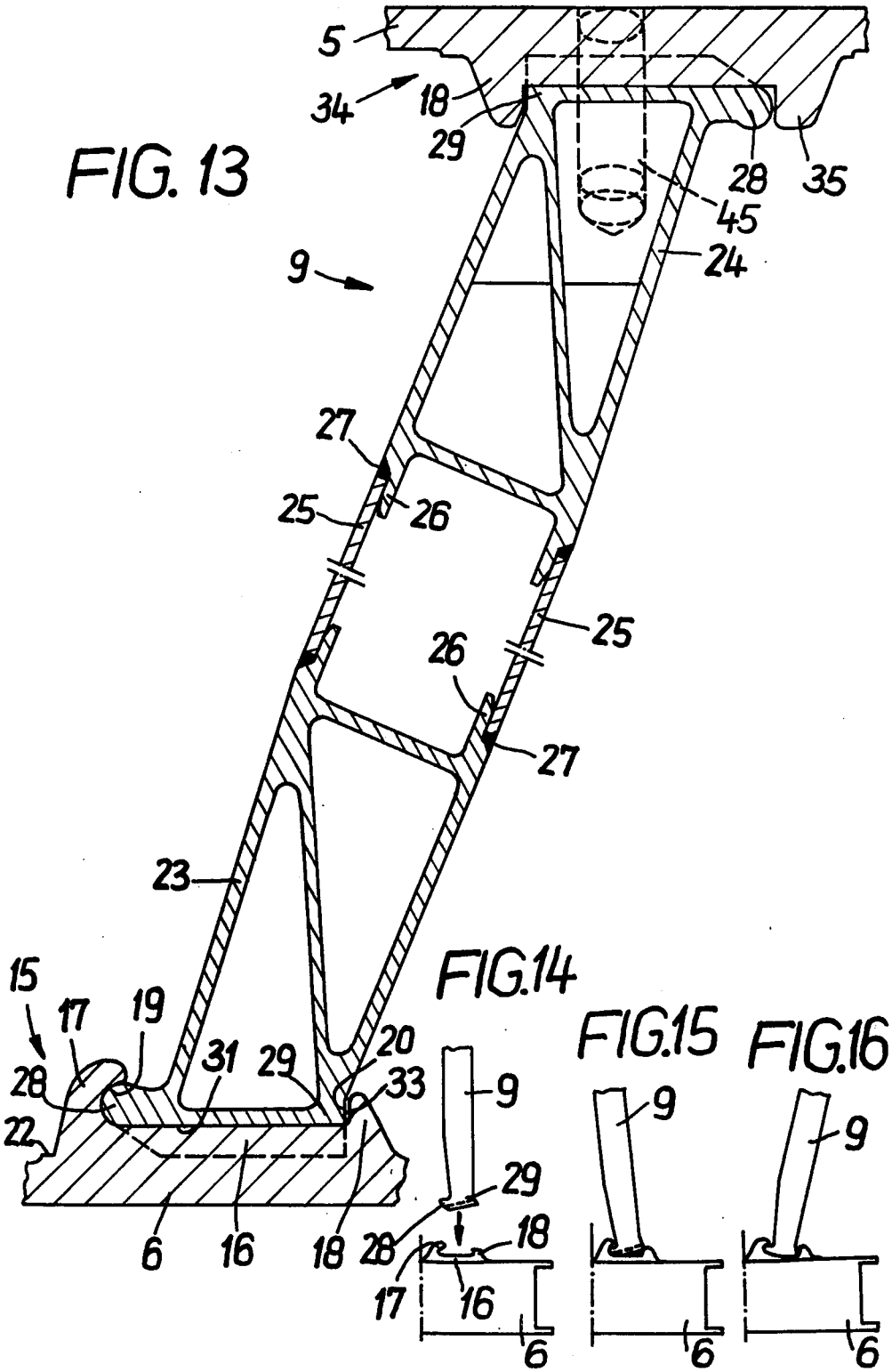
FIG. 13 shows a vertical section through a wall of a beam and the adjacent portions of the lower chord and upper chord.

FIG. 13 shows the plate or strut member 9 in built-in condition in which it is so connected to the lower plate element or supporting member 6 that between strut member 9 and said supporting member 6 considerable forces can be transmitted in all directions. At the same time, the strut member 6 is connected to the upper supporting member 5 in such a way that between the strut member 9 and the supporting member 5 considerable forces can be transmitted in the longitudinal direction of the beam as well as transverse thereto.

Figure 10:
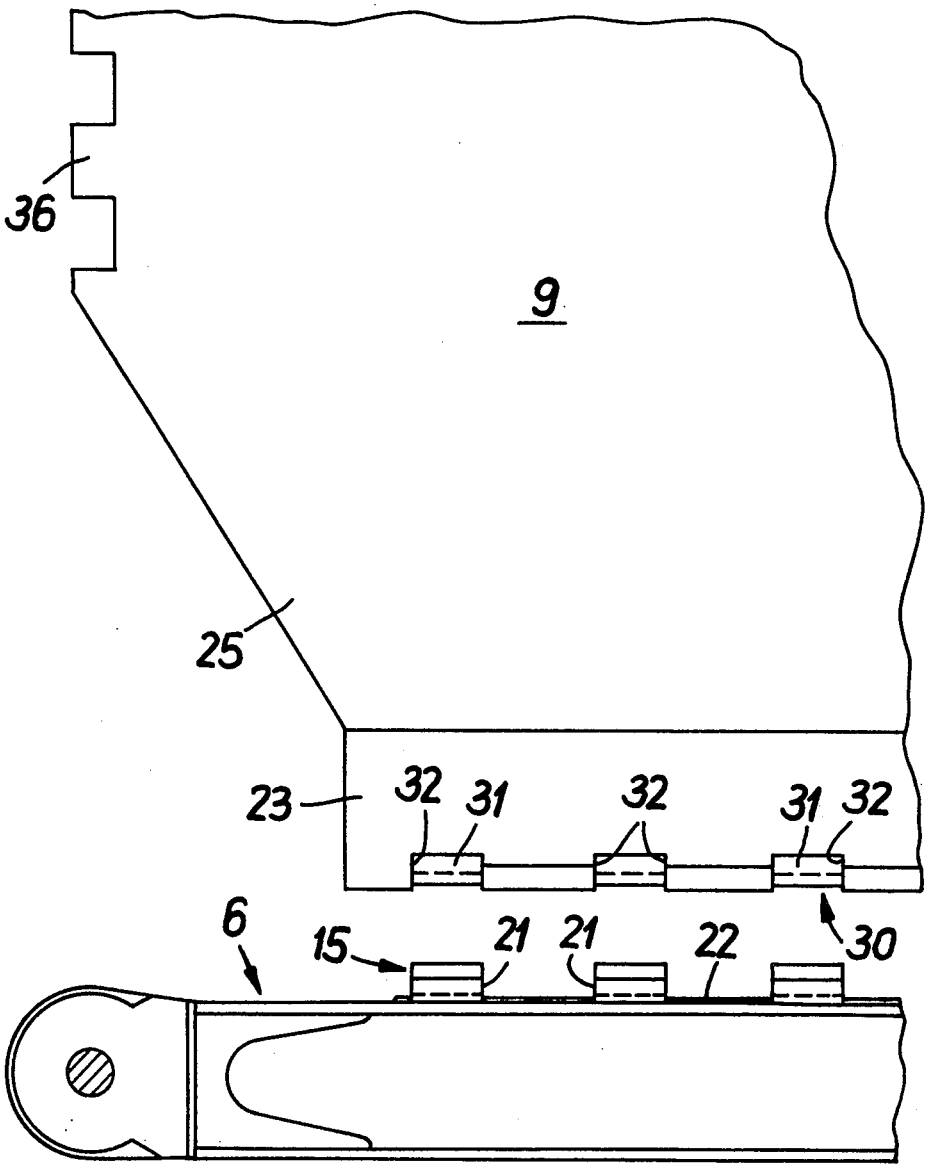
FIG. 10 illustrates in side view portions of the lower chord and of a wall.

Each of the two rim sections 23, 24 forms a foot with a bead head or toe element 28 and a heel 29. Milled out of the foot is a groove 30 having a rectangular cross section (FIG. 10). In this way, a resting surface 31 for the foot as well as vertical guiding surfaces 32 are formed.

In the position of installation of the strut member 9 as shown in FIG. 13, the foot of the lower rim section 23 is fixedly arranged in one of the coupling members 15. The resting surface 31 is located on the elevation 16. The bead or toe element 28 which is directed in the direction toward the vertical longitudinal central plane of the lower supporting member 6 is located so as to fit in the channel or fillet 19 of the hook-shaped cam or elevation 17. The heel 29 rests by means of a vertical surface 33 facing away from bead or toe element 28 against the cam 18. The lateral guiding surfaces 32 rest against the vertical end faces 21 (FIG. 10) of the coupling member.

Accordingly, horizontal forces acting transverse to the longitudinal direction of the beam between the strut 9 and the lower supporting member 6 are absorbed by the or toe element 28 and cam 17 and by the heel 29 and cam 18. Horizontal forces which act in the longitudinal direction of the beam between the strut 9 and the lower supporting member 6 are transmitted by the surfaces 32, 21 which rest against each other. Forces which in vertical direction act from the strut 9 in downward direction upon the lower supporting member 6 are by means of the resting surface 31 conveyed onto the elevation 16. Forces which act in upward direction upon the strut 9 cannot lift the strut 9 off the lower supporting member 6 because the hook-shaped cam 17 extends over the bead or toe element 28, and a turning of the strut 9 in counterclockwise direction is prevented by the upper supporting member 5.

Thus, the strut 9 which forms an inclined wall of the carrier or beam section 1 is so connected to the supporting member 6 forming the lower chord that forces acting in all directions will be absorbed.

FIGS. 14, 15 and 16 illustrate how the strut 9 is coupled to the lower supporting member 6. According to FIG. 14, strut 9 is located first in vertical direction above the respective coupling member 15. This position is also illustrated in FIG. 10. According to FIG. 15, the strut 9 is with a slight inclination toward the vertical longitudinal central plane of the supporting member 6 so inserted into the coupling member 15 that the bead or toe element engages the channel or fillet 19, and these two parts form a pivot joint. According to FIG. 16, the strut 9 is then pivoted in opposite direction until it occupies the position illustrated in FIG. 13. Those sections of the foot of the lower rim section 23 which are left when milling the grooves 30, fill the gaps between the three coupling members 15 which are arranged in spaced relationship to each other. When the strut 8 which forms the other wall of the section 1 is in the same manner as strut 9 connected to the supporting member 6 forming the lower chord, by means of the respective coupling member 15, the supporting member 5 forming the upper chord is placed upon the upper rims of the two struts 8, 9. The bead or toe element 28 of the upper rim sections 24 extends in the direction of the vertical longitudinal central plane of the supporting member 6, whereas the heels 29 face said plane. The upper supporting member 5 has its bottom side provided with coupling members 36 which correspond to the coupling members 15 of the lower supporting member with the only difference being that instead of the hook-shaped cams 17, simple cams 35 are provided which do not extend beyond the beads or toe element 28. Therefore, the upper supporting member 5 can by a vertical movement in downward direction be so placed upon the feet of the upper rim sections 24 of the two strut means 8 and 9 that each coupling members 34 will by means of the cams 18 and 34 grasp the heel 29 and bead or toe element 28, and that the guiding surfaces 32 of the milled groove 30 rest against the end faces 21 of the coupling members 34 so that horizontal forces acting in any desired direction will be transmitted between the upper supporting member 5 and the struts 8, 9.

A lifting of the upper supporting member 5 off the struts 8, 9 will be prevented by the fact that non-illustrated drop bolts which are guided in the upper supporting member 5 lock in corresponding recesses of the upper rim sections 24. Thus, without using bolts submitting great forces, a connection between the four supporting members 5, 6, 8 and 9 is established in a minimum of time and the connection is stiff in all directions.

Figure 7:
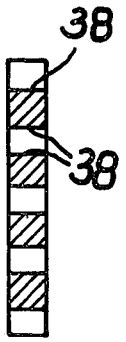
FIG. 7 represents a section taken along the line VII-VII of FIG. 6.

The strut means 8, 9 of each supporting member 1 are, as shown in FIG. 6, connected to each other with the corresponding struts for instance **9*a* of the adjacent carrier member, by means of teeth. According to FIG. 6, the teeth 36, 37 have a rectangular profile, and their flanks 38 (FIG. 7) form planes which are located at a right angle to the lateral surfaces of the struts 9, 9*a*** which act in the direction of the height and parallel to the lateral surfaces of the struts.

Figure 8:
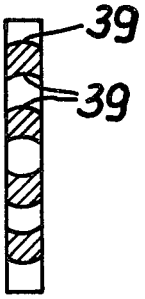
FIG. 8 represents a section similar to that of FIG. 7 but through a modified design of a bridge beam.

A modification of the just described arrangement is shown in FIG. 8 where the flanks 39 of the teeth form cylindrical surfaces. Such teeth furthermore transmit also such forces which act between the two plates or struts **9, 9*a*** in a direction perpendicular to the lateral surfaces thereof.

Figure 11:
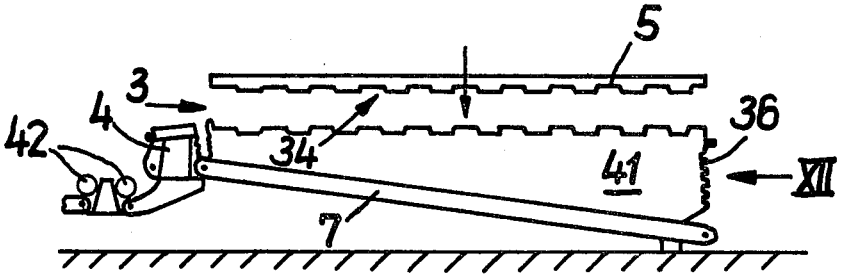
FIG. 11 shows in side view portions of a ramp-shaped beam section with means for aiding in the assembly thereof.
Figure 12:
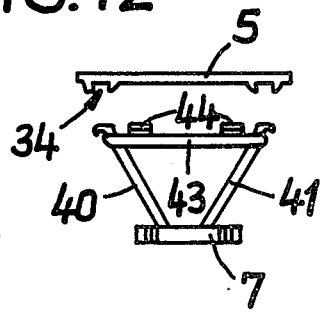
FIG. 12 illustrates an end view of FIG. 11 as seen in the direction of the arrow XII.

The ramp-shaped sections 2, 3 are principally composed of four struts in the same manner as the ordinary supporting sections. FIGS. 11 and 12 show that two inclined side walls 40, 41 the heights of which taper toward one end of the section 3, are placed upon the plate 7 which forms the lower chord. The connections of the parts 40 and 41 on the plate 7 are effected by means of the same coupling members which serve for the above mentioned connection of the struts 8, 9 of the ordinary carrier member 1 at the lower supporting member. According to FIG. 11, the lower plate 7 is supported temporarily for facilitating the installation in an inclined position and more specifically on edge by the bank beam 4 which is to be rolled forward by means of rollers 42. The upper rims of the struts 40, 41 are horizontal. In this position, the plates are temporarily held by a spacer 43. This spacer carries rollers 44 for easier installation of the upper supporting member 5. This supporting member 5 is shown in FIGS. 11 and 12 spaced from and above the struts 40 and 41. The supporting member 5 rests upon the upper rim sections of struts 40 and 41 and is firmly connected thereto in the same manner as has been described for connecting the upper supporting member 5 to the struts 8, 9 of the ordinary carrier member (see FIG. 13).

It is, of course, to be understood that the present invention is, by no means, limited to the specific showing in the drawings, but also comprises any modifications within the scope of the appended claims.

What we claim is:

1. A framework, especially for a portable bridge, which includes in combination: at least two supporting members arranged in spaced relationship to and one above the other, first and second coupling means respectively connected to said at least two supporting members, strut means detachably interconnecting said at least two supporting members, one portion of said strut means being operable so as to positively engage one of said coupling means angularly to permit the latter to transmit pivot forces in all directions, and the other one of said coupling means being operable when said one coupling means is in positive engagement with said one portion of said strut means to prevent said strut means from disengaging said one coupling means.

2. A framework especially for a portable bridge, which includes: at least two supporting members arranged in spaced relationship to and one above the other, first and second coupling means respectively connected to said at least two supporting members, strut means detachably interconnecting said at least two supporting members, one portion of said strut means being operable so as to positively engage one of said coupling means to permit the latter to transmit forces in all directions, and the other one of said coupling means being operable when said one coupling means is in positive engagement with said one portion of said strut means to prevent said strut means from disengaging said one coupling means, said one portion of said strut means being provided with a bead and opposite said bead and in spaced relationship thereto has a surface section, said one coupling means comprising at least two elevations, one of which is hook-shaped for coupling engagement with said bead and forms therewith a swivel joint whereas the other elevation is arranged and designed for engagement with said surface section when said hook-shaped elevation is in coupling engagement with said bead.

3. A framework according to claim 2, which includes at least one beam comprising a plurality of sections each of which is composed of four plates, one of which forms an upper chord while the opposite plate forms a lower chord, and while the other two plates represent two walls forming part of said struts and being inclined relative to each other, each of said lower and upper ends of said side walls being provided with said beads and said surface sections, while the top side of said lower chord is provided with said pair of elevations.

4. A framework according to claim 3, in which at least some of said plurality of sections have a triangular cross section.

5. A framework according to claim 3, in which at least some of said plurality of sections have a trapezoidal cross section.

6. A framework according to claim 2, in which those sections of said plurality of sections which are located in the end area of said at least one beam decrease in height toward the ends of said at least one beam.

7. A framework according to claim 3, in which said lower and upper chords respectively form part of said at least two supporting members, and in which the beads of said lower and upper ends of said side walls slide fit between said elevations in said lower and upper chords, said framework also including locking means for preventing accidental lifting off of said upper chord from said two walls inclined relative to each other.

8. A framework according to claim 3, in which said lower chord is formed by an extruded hollow plate with said elevations of said coupling means forming a single integral part therewith.

9. A framework according to claim 2, in which said strut means include upper and lower extended sections.

10. A framework according to claim 9 in which each of said strut means includes an intermediate section in overlapping engagement with said upper and lower extended sections and welded thereto.

11. A framework according to claim 3, in which said inclined walls of each two adjacent sections of said plurality of sections are on one and the same side thereof provided with teeth with the teeth of one section meshing with the teeth of the respective adjacent section for preventing at least a displacement of said adjacent walls relative to each other in upward and downward direction parallel to the side surfaces of said walls.

12. A framework according to claim 11, in which the teeth have plane flanks extending at a right angle to the side surfaces of said walls.

13. A framework according to claim 11, in which the teeth have flanks curved in such a way as to prevent an offsetting of the walls relative to each other and transverse to the side surfaces thereof.

* * * * *